US010039692B2

(12) United States Patent
Nickelson

(10) Patent No.: US 10,039,692 B2
(45) Date of Patent: Aug. 7, 2018

(54) PORTABLE ARTICLE FOR ADMINISTERING THERAPY TO A USER

(71) Applicant: GENERAL MEDVENTURES INTERNATIONAL, LLC, Earth City, MO (US)

(72) Inventor: Danny L. Nickelson, Pacific, MO (US)

(73) Assignee: General Medventures International LLC, Earth City, MO (US)

( * ) Notice: Subject to any disclaimer, the term of this patent is extended or adjusted under 35 U.S.C. 154(b) by 528 days.

(21) Appl. No.: 14/350,339

(22) PCT Filed: Oct. 5, 2012

(86) PCT No.: PCT/US2012/058986
§ 371 (c)(1),
(2) Date: Apr. 7, 2014

(87) PCT Pub. No.: WO2013/052817
PCT Pub. Date: Apr. 11, 2013

(65) Prior Publication Data

US 2014/0257153 A1 Sep. 11, 2014

Related U.S. Application Data

(60) Provisional application No. 61/544,115, filed on Oct. 6, 2011.

(51) Int. Cl.
*A61H 23/02* (2006.01)
*A61H 23/00* (2006.01)
(Continued)

(52) U.S. Cl.
CPC ..... *A61H 23/0263* (2013.01); *A61H 23/00* (2013.01); *A61H 23/006* (2013.01);
(Continued)

(58) Field of Classification Search
CPC ..... A61H 7/00; A61H 7/001; A61H 7/002; A61H 7/004; A61H 7/007;
(Continued)

(56) References Cited

U.S. PATENT DOCUMENTS 4,098,266 A * 7/1978 Muchisky ..... A61H 23/0263 601/108
5,078,134 A 1/1992 Heilman et al.
(Continued)

OTHER PUBLICATIONS

International Search Report corresponding to International Application No. PCT/US2012/058986 dated Mar. 25, 2013.
(Continued)

*Primary Examiner* — Colin W Stuart
(74) *Attorney, Agent, or Firm* — Sandberg Phoenix & von Gontard P.C.

(57) ABSTRACT

A portable article for administrating therapy to a user includes a device positioned along the area of the body requiring therapy. At least one power pod is associated with the device and the power pod simultaneously applies a first force component perpendicular to the user's body surface and a second force component parallel to the user's body surface. An illustrative embodiment is a vest worn by the user during therapy.

23 Claims, 8 Drawing Sheets

(51) Int. Cl.
*A61H 23/04* (2006.01)
*A61H 1/00* (2006.01)

(52) U.S. Cl.
CPC ..... *A61H 23/02* (2013.01); *A61H 23/0254* (2013.01); *A61H 1/008* (2013.01); *A61H 23/04* (2013.01); *A61H 2023/0272* (2013.01); *A61H 2201/165* (2013.01); *A61H 2201/5002* (2013.01); *A61H 2205/084* (2013.01)

(58) Field of Classification Search
CPC .. A61H 2011/005; A61H 11/00; A61H 23/00; A61H 23/02; A61H 23/0254; A61H 23/0263; A61H 2023/002; A61H 2023/0272; A61H 23/006
USPC .... 601/150, 46, 60, 65, 67, 69, 70, 71, 136, 601/151, 152
See application file for complete search history.

(56) References Cited

U.S. PATENT DOCUMENTS

| | | | | |
|---|---|---|---|---|
| 6,151,528 | A | 11/2000 | Maida | |
| 7,207,953 | B1 * | 4/2007 | Goicaj | A61H 23/02 601/134 |
| 8,579,841 | B2 * | 11/2013 | Khan | A61H 9/0078 601/148 |
| 2003/0158593 | A1 | 8/2003 | Heilman et al. | |
| 2004/0133133 | A1 * | 7/2004 | Dreimann | A61H 23/0263 601/15 |
| 2005/0235988 | A1 * | 10/2005 | Hansen | A61H 9/0078 128/200.24 |
| 2006/0089575 | A1 * | 4/2006 | DeVlieger | A61H 23/0263 601/70 |

OTHER PUBLICATIONS

International Written Opinion corresponding to International Application No. PCT/US2012/058986 dated Mar. 25, 2013.

* cited by examiner

Legend device 3
vest 22
connector 5
control panel 7
controller 9
power source 15
power supply 11
connector 13
battery 17

PORTABLE ARTICLE FOR ADMINISTERING THERAPY TO A USER

CROSS-REFERENCE TO RELATED APPLICATIONS

This application claims priority to provisional application 61/544,175 filed Oct. 6, 2011, which is incorporated herein by reference.

STATEMENT REGARDING FEDERALLY SPONSORED RESEARCH

None

BACKGROUND OF THE INVENTION

This disclosure relates to a portable article including a device and method for administrating therapy to a user. While the disclosure is directed specifically to treating impaired airway clearance for users or patients suffering from a variety of medical conditions that the effect lung function of the patient, those skilled in the art will recognize the wider applicability of the inventive principles discussed hereinafter.

Medical conditions that would benefit from improved lung drainage and more effective airway clearance include Cystic Fibrosis, Bronchiectasis, Pneumonia, and all other COPD (Chronic Obstructive Pulmonary Disease), for example. Airway clearance is the elimination of excess mucus and contaminants from the lungs. Natural airway clearance is accomplished when certain body mechanisms interact effectively. Mucus is secreted to entrap harmful substances and keep airways clean; natural filters such as nasal hairs help capture contaminants; cilia continuously sweep mucus from the lower segments of the lungs to upper airways; and coughing and sneezing clears the mucus from the respiratory system.

Natural airway clearance is extremely important because the process helps people stay healthy and breather easier, Mucus that accumulate in the lungs may lead to very serious complications including death. Excessive or retained mucus creates an ideal environment for the growth of infection-causing pathogens. These infections can damage healthy lung tissue and make breathing more difficult.

The assignee of the present disclosure has had a long history in providing treatment for impaired airway clearance. Various commercial products were and are sold under its well-known trademarks, including merely by way of example and not of limitation, Flimm Fighter®, Directional-Stroking®, Neo-Cussor™ VibraCare®, Therassist®, and Medatilt. For years, patients with impaired airway clearance relied upon manual chest physical therapy (CPT). Products employing the Directional-Stroking® method are particularly effective for airway clearance. However, while these and other associated products work well for their intended purpose, they often are not easily adapted for self administration. That is to say, a second person (care giver) is needed for use with the product or products in conjunction with the therapy being applied to the patient. As indicated above, products employing the Directional-Stroking® technique are particularly effective in loosening and moving contaminants and mucus from the lungs, for example, to the larger airways (i.e. thorax), where they can be coughed out.

A series of products are known in the art which employ what their manufacturers refer to as high frequency chest wall oscillation techniques, most of which use a vest or wrap which is worn by the patient. An air compressor and at least one associated hose are connected from the air compressor to the vest or wrap. In operation, the air compressor must be continuously-connected to a 120 volt or 220 volt electrical power source throughout the full period of each treatment. While those products claim to be portable, all require an external bulky and noisy air compressor and connecting hose extending from the compressor to the vest or wrap, and an available connection to a 120 volt or 220 volt power source. The competitive systems are portable only in the analogous sense that the original portable compressors, weighing approximately fifteen pounds, were portable compressors. The vest and compressors can be lugged around, but they truly are not portable as that term has become to be understood in the art or by the consuming public.

As disclosed below, a completely safe, truly portable, self-contained, easy-to-use article is provided for unattended use by both children and adults. The article, sometimes referred to herein after as a G5® Freedom™ system, in one illustrative embodiment, includes a vest or wrap made operational by the provision of a plurality of recessed pockets and/or attachment provisions on or in the article positioned adjacent to the major lung segments, both topical and apical when the article is worn by the patient. The pockets or attachment provisions hold at least one self-contained power module or power pod adapted to provide the "Direction Stoking" forces to the patient without the need for an attendant or caregiver for the patient. As will be appreciated by those skilled in the art, the number of potential embodiments employing the inventive constructions disclosed hereinafter is limited only by one's imagination.

BRIEF SUMMARY OF THE INVENTION

In accordance with this disclosure, generally stated, a simplified, portable article is provided for administrating air way clearance therapy, for example, by the application of selective-segment, sequentially-synchronized percussive Directional Stroking force to the patient. In one preferred embodiment, the article includes a specialized vest which is worn by a patient during therapy. This vest has a plurality of pockets formed in it, each of which are sized to receive a power pod, placing the pods in close proximity to areas of the patient's body requiring therapy. The power pods are designed to provide therapy to the patient. An electronic controller enables the therapist or patient to select and control the manner in which each individual power pod is energized, and at what frequency, in which sequence, and at which specific location on the patient.

One feature of the disclosure is the ability to provide selective energy adjustment using a low voltage twelve volt power source, which even when combined with various forms of the article offers a low weight system when compared to other available therapeutic devices designed for similar purposes.

Another feature of the disclosure is the ability to provide an article which can be constructed to permit proper orientation of the power pods so as to apply the desired therapy at the specific location on a patient, for example, when using the article.

Another feature of the disclosure is the preferred construction of power pods for a particular article in which the enclosure of the power pods transmits the force to the patient Yet another feature of the disclosure is that once the article is place on a patient, the treatment provides for hands free operation.

Another feature of the disclosure is the provision of a power pod construction which can be operated from a variety of power sources, including for example battery operation and/or air while the operation of any part of the article utilizing the power pod remains therapeutically consistent.

Other features of the disclosure will be apparent to those skilled in the art in view of the following description and accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the article for which Letters Patent is sought by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 1:
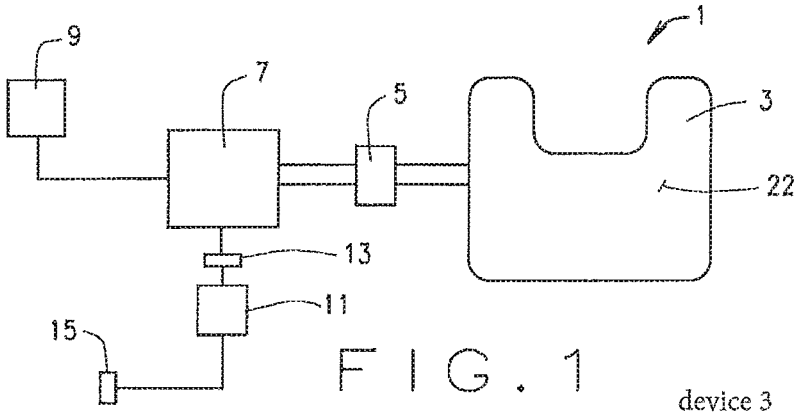
FIG. 1 is a diagrammatic view of one illustrative embodiment of article of the present disclosure.

Referring now to FIG. 1, reference numeral 1 indicates one illustrative article of the present disclosure in one of its preferred forms. The embodiment of FIG. 1, illustrates a device 3 in the form of a vest 22 worn by a user, as later described in greater detail. The vest 22 is operatively connected through a connector 5 to a control panel 7. The control panel 7 has a first input side operatively connected to a controller 9 and a second input operably connected to a power source 15 through a suitable source of power, which in the embodiment is a low voltage power supply 11 and a connector 13.

The power source 15 preferably is a source of 120-220 volt electrical energy commonly obtained at a conventional electrical plug connected to the power grid. The power supply 11 reduces the electrical energy from the power source 15 to a low level electrical source for the control panel 7.

Figure 1B:
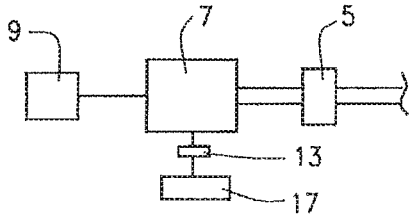
FIG. 1B is a diagrammatic view of a second illustrative embodiment, partly broken away, of the article show in FIG. 1

As will be appreciated by those skilled in the art, while FIG. 1 describes one source of electrical energy for operation of the device 1, the power source 15 may be replaced by a battery source of energy 17 without altering other components of the device 1. A battery power source is shown in FIG. 1B. As can be further appreciated by those skilled in the art, while some form of electrical operation is preferred, the design also can be easily converted to accommodate an air powered source of energy in the form of a suitable air compressor. I have found, however, electrically energized forms of the article 1 are preferred in application use.

Figure 2:
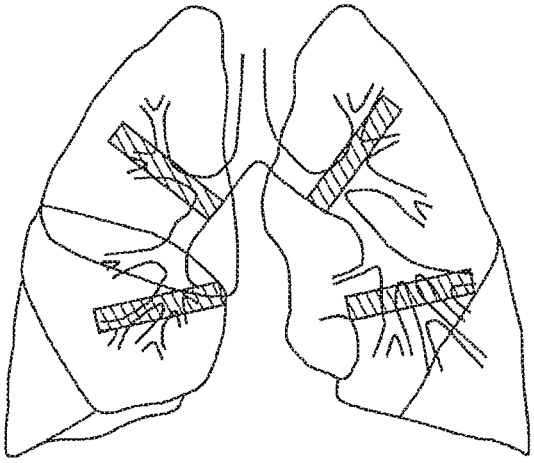
FIG. 2 is a diagrammatic view showing the human lungs with which the embodiment of FIG. 1 finds application.
Figure 3:
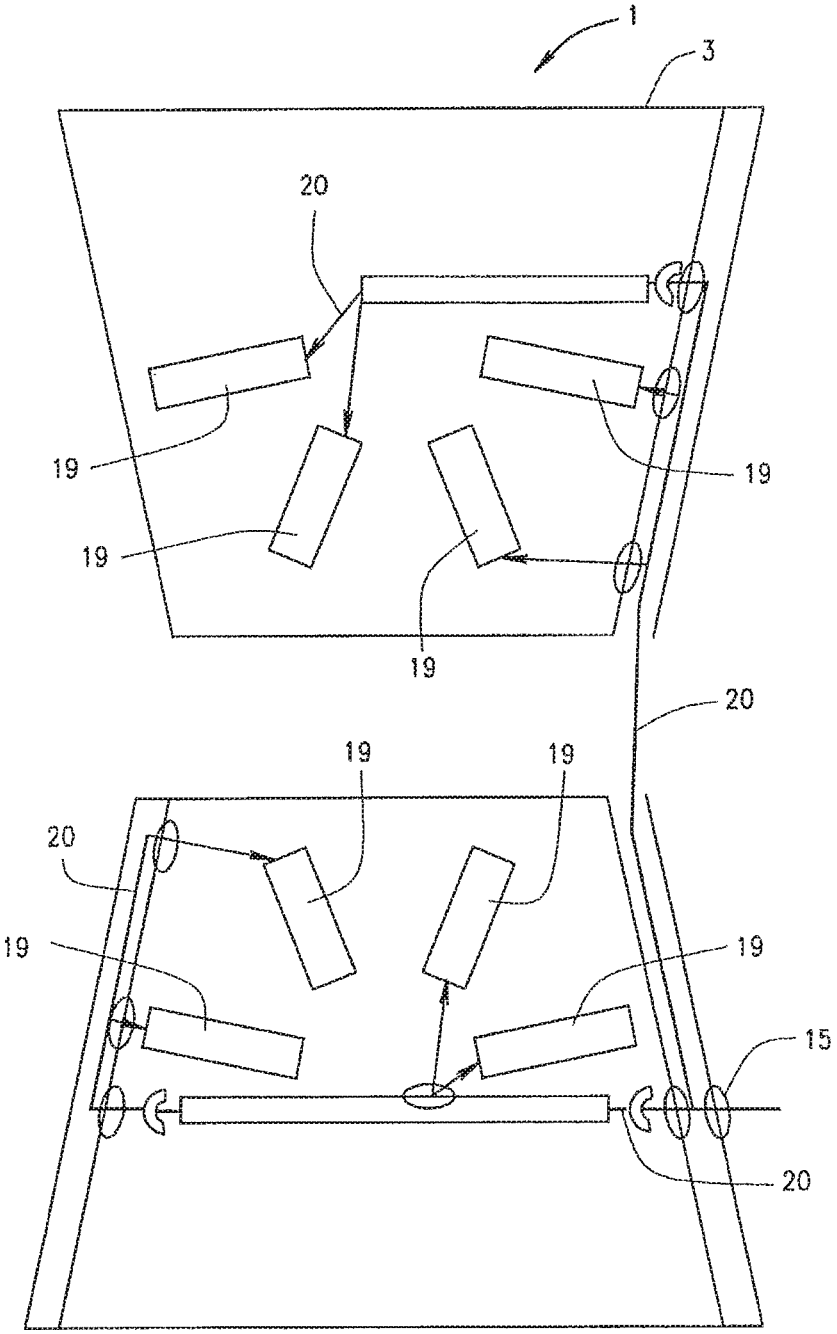
FIG. 3 is a diagrammatic view of the embodiment of FIG. 1 showing one illustrative arrangement of a connection diagram for a plurality of power pods employed with the embodiment of FIG. 1.
Figure 7:
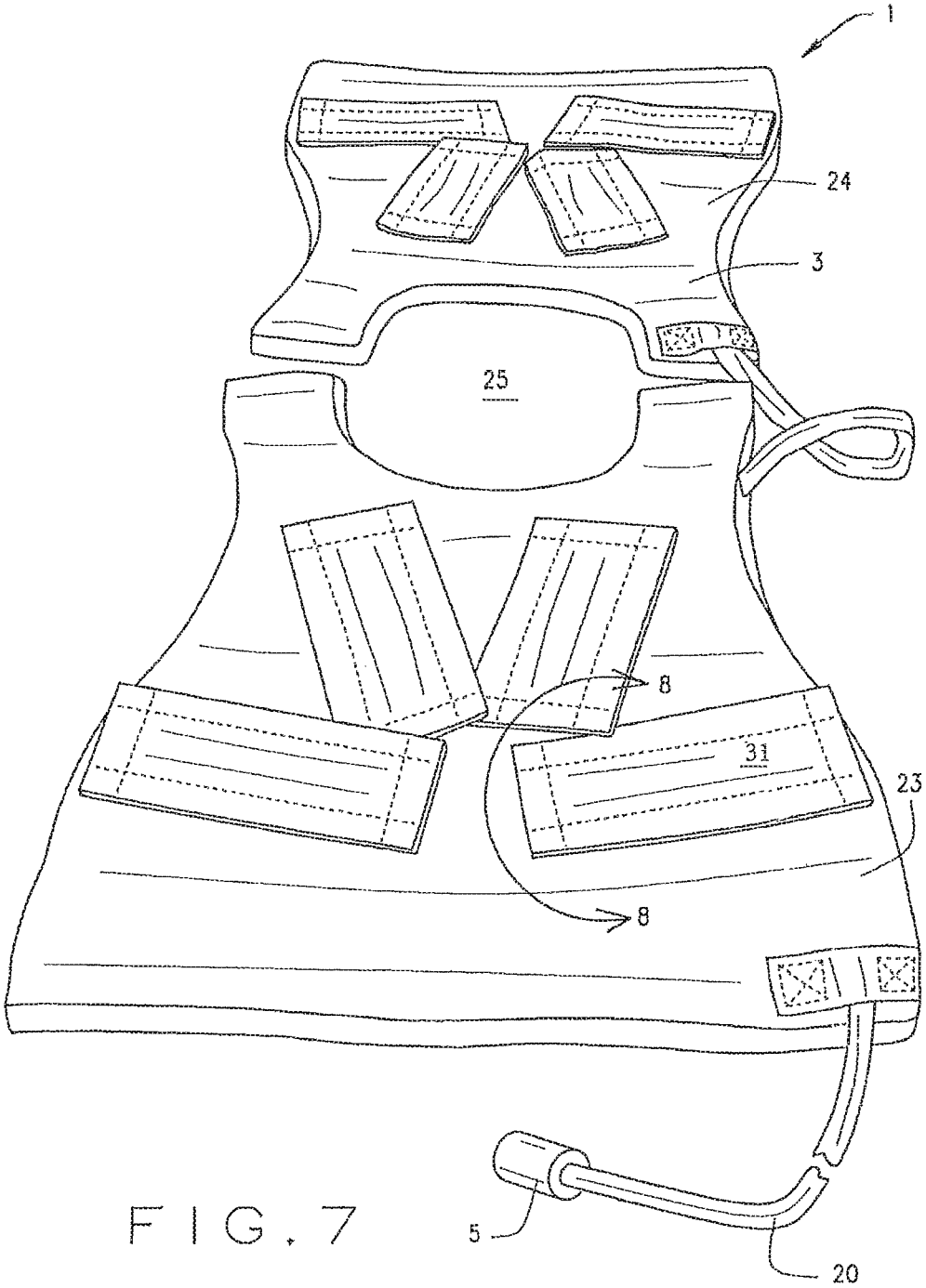
FIG. 7 is a view in perspective of the inward patient facing side of the article shown in FIG. 1.

As is best seen in FIG. 7, the article 1, preferably in the vest 22 form, includes a first part 23 and a second part 24. The vest 22 may assume a variety of configurations and designs. In the embodiment shown, the parts 23 and 24 are sized to cover the back and chest of the intended user and define a central head opening 25. The parts 23 and 24 of the vest 22 are shown in diagrammatic form in FIG. 3. As shown, the connector 5 is operatively associated with a circuit 20 which is arranged on or about the parts 23 and 24 so as to interconnect a plurality of power pods 19 carried by the parts 23 and 24. The particular location of the power pods 19 with respect to the vest 22 is an important consideration. In the embodiment shown in FIG. 3, for example, the power pod 19 locations are selected to overlay the lungs of a user on both of the chest and back sides of the user. Placement of the power pods 19 with respect to the lungs is illustratively shown in FIG. 2 and, as later described in greater detail, the power pods 19 operating to provide drainage of fluids from the lungs of a user so that the fluids can be naturally expelled by the user.

Figure 8:
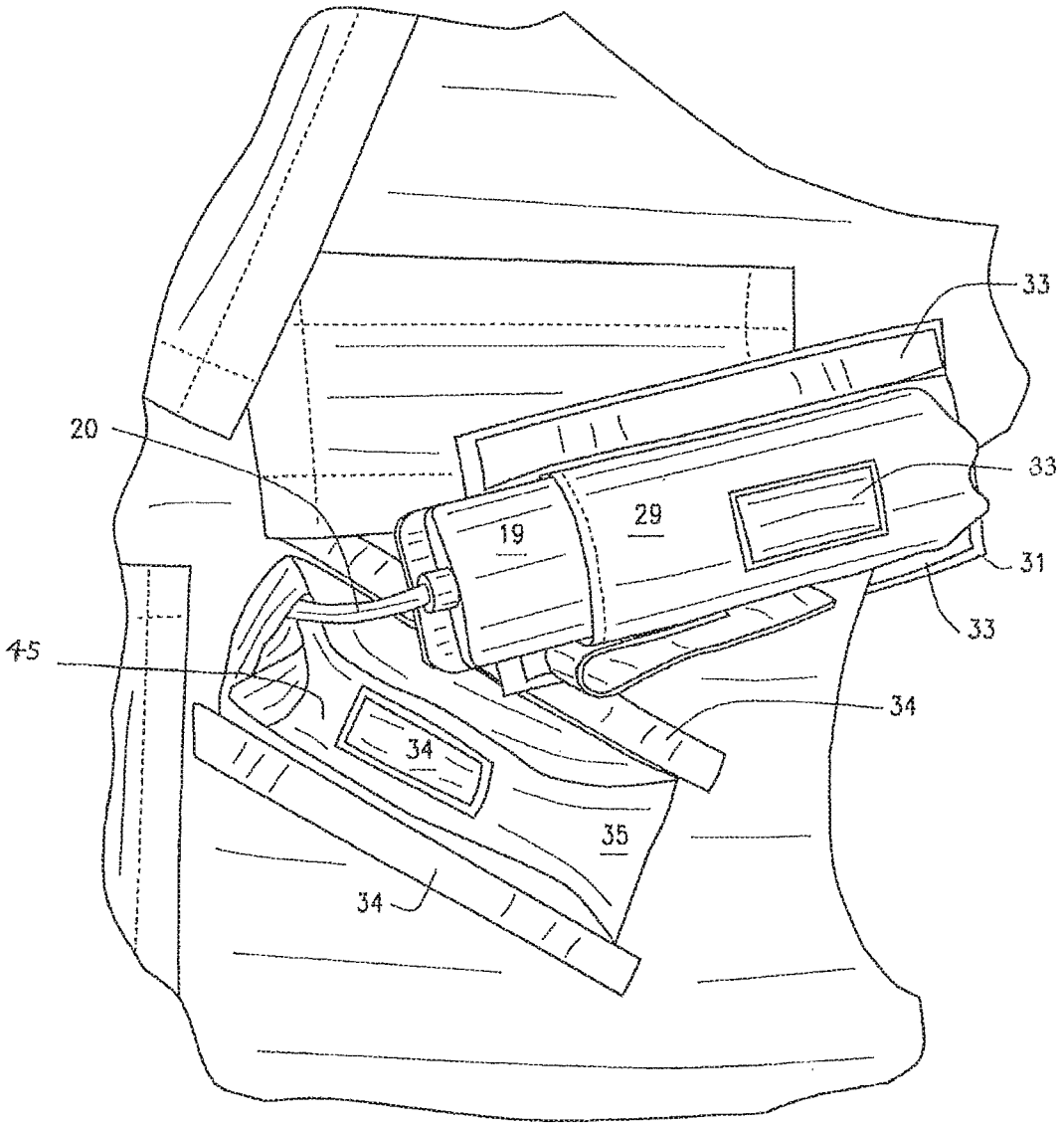
FIG. 8 is an enlarged view in perspective, partly broken away taken about the line 8-8 in FIG. 7, illustrating the power pod holder and one illustrative attachment method for the power pod.
Figure 9A:
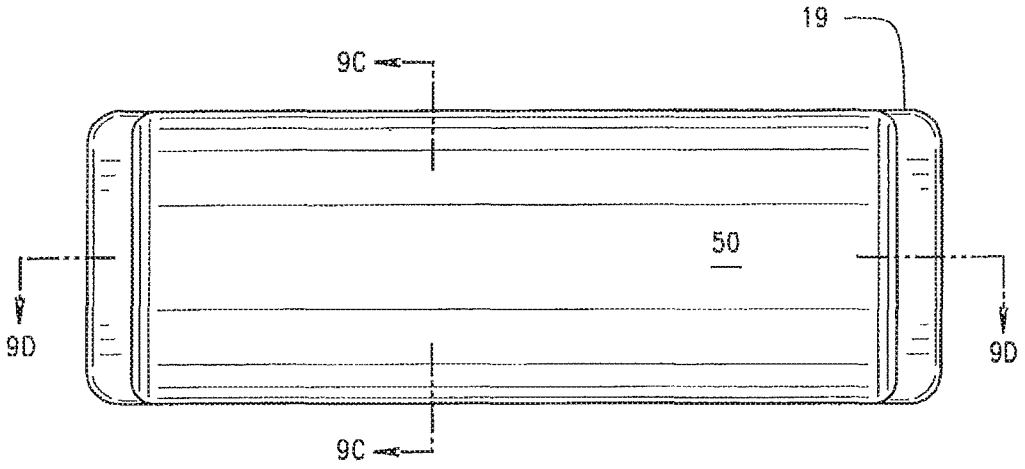
FIG. 9A is a top plan view of one illustrative embodiment of power pod employed with the embodiments of FIGS. 7 and 5.
Figure 9B:
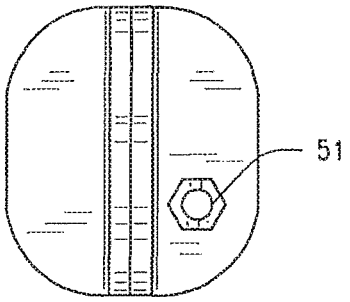
FIG. 9B is an end view of the power pod shown in FIG. 9A
Figure 9C:
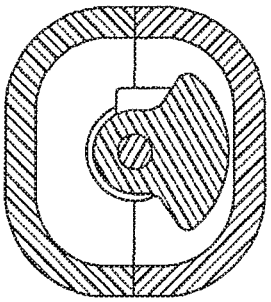
FIG. 9C is a sectional view taken along the line 9C of FIG. 9A
Figure 9D:
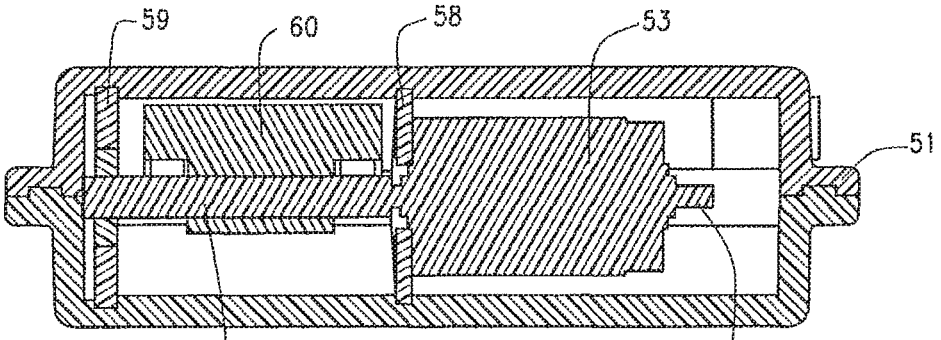
FIG. 9D is a sectional view taken along the line 9D of FIG. 9A.
Figure 10A:
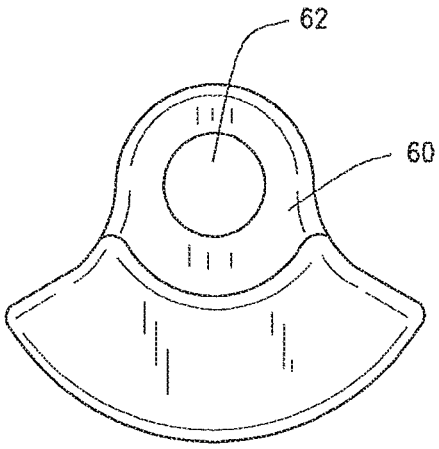
FIG. 10A is an end view of an eccentric employed with the power pod of FIG. 9.
Figure 10B:
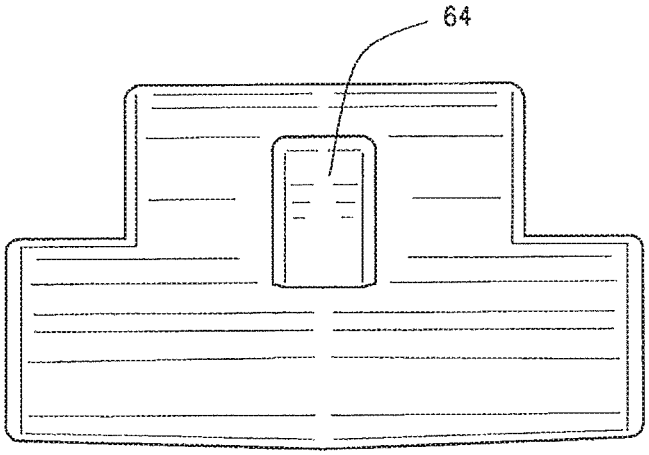
FIG. 10B is a side view of the eccentric shown in FIG. 10A.

Referring now to FIG. 8, the power pods 19 are mounted within a pocket 29 formed integrally with a cover part 31. In the embodiment illustrated, the cover part 31 includes hook and loop fastening material 33 positioned along a longitudinal axis of the pocket part 29 and along the edges of the cover part 31. Corresponding hook and loop material 34 is positioned about the mouth of a cavity 35 formed in the article 1, and along a bottom wall 45 of the cavity 35. The number of cavities required is a matter of design choice. In the preferred embodiment illustrated, four cavities 35 are formed in each of the parts 23 and 24 of the vest 22. FIG. 8 illustrates the pocket 29 removed from a cavity 35, while FIG. 7 shows a cover part 31 in position or in their respective cavities in the closed and operating position of the cover part 31. Those skilled in the art will recognize that other methods of attachment and placement of the power pods 19 are compatible the broader aspects of the disclosure.

Figure 6:
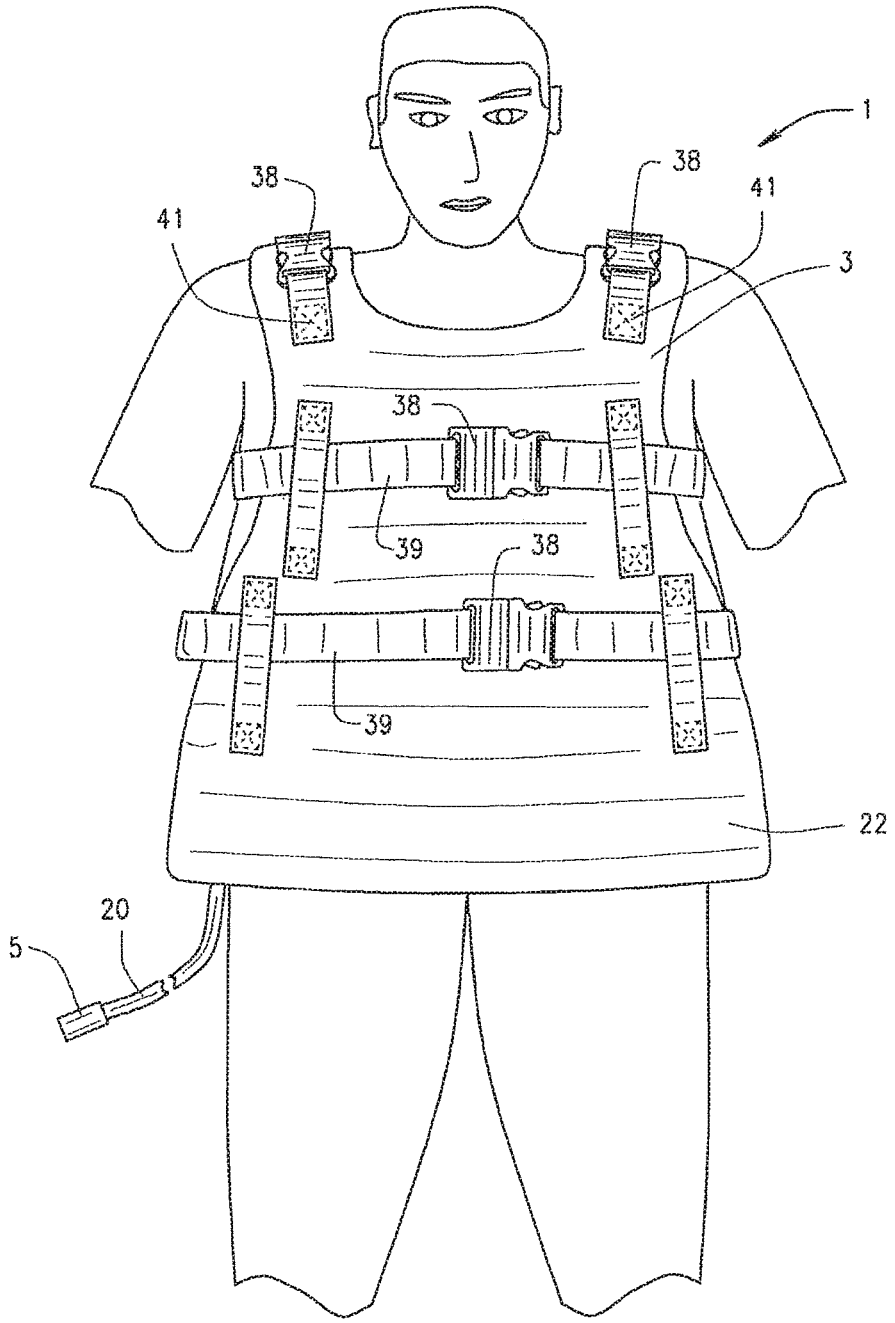
FIG. 6 is a view in perspective, partly broken away, of the outward facing side of article shown in FIG. 1.

FIG. 6 illustrates the vest 22 attached to a user of the device 1. Preferably the vest 22 is worn by and attached to the user through the use of conventional strap 41 and snap buckles 38. As shown in FIG. 6, a pair of strap 41 and buckle 38 combinations function to attach the vest parts 23 and 24 of the vest 22 over the shoulders of the user. Similarly, the vest 22 also attaches to a user's torso in the embodiment shown in FIG. 6 and the parts 23 and 24 are maintained in position by an arrangement of strap 39 and buckle 38 combinations. Other methods of attachment will be apparent to those skilled in the art.

The buckles 38 and strap 41 combination along the top of the vest parts 23 and 24, referenced to FIG. 6 act as shoulder straps and serve a practical function besides connecting the parts 23 and 24 of the vest 22. I have found that use of the shoulder straps 41 allows the vest 22 to accommodate a variety of torso lengths for any particularly user, while the straps 39 and buckles 38 likewise can accommodate a variety of different physical configurations of the intended user so that one particular configuration of the vest 22 will accommodate users having a variety of physical body configurations. The buckle 38 and strap 41 define at least one adjustable closure for the vest 22. Those skilled in the art, of course, will recognize that the vest 22 may have a one piece construction if, desired.

Figure 4:
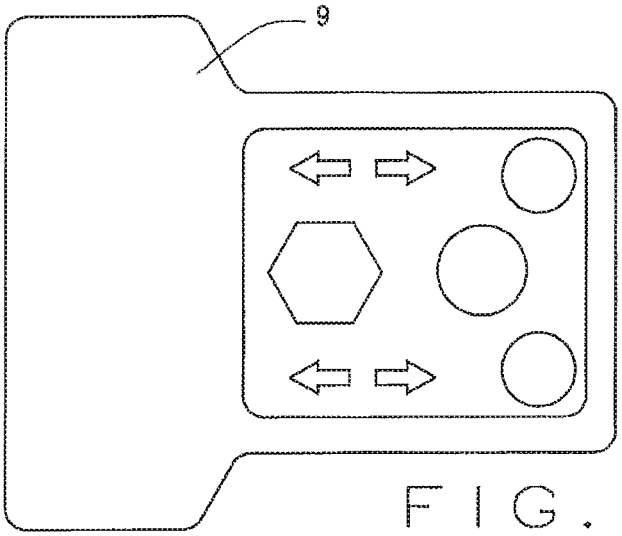
FIG. 4 is a top plan view of one illustrative embodiment for control device shown in FIG. 1.
Figure 5A:
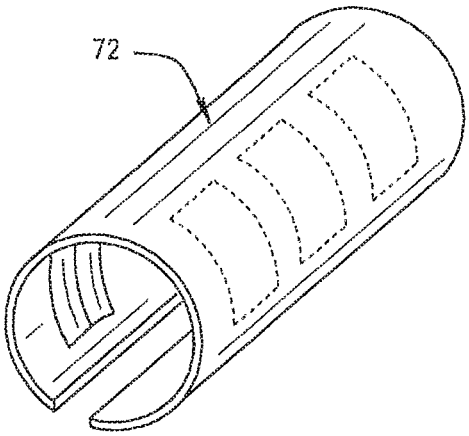
FIG. 5A-5D views of a second illustrative embodiment of article of the present disclosure.
Figure 5B:
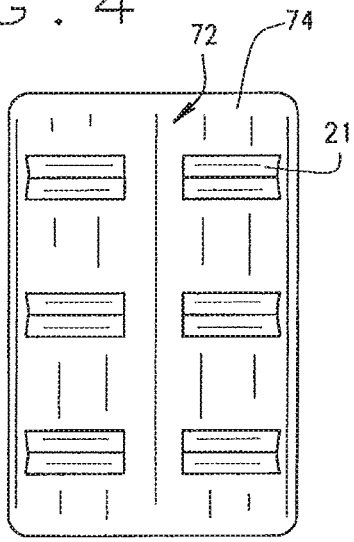
Figure 5C:
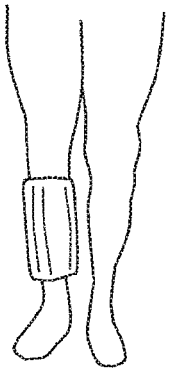
Figure 5D:
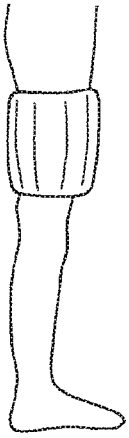

One illustrative embodiment of the controller 9 compatible with the vest 22 is shown in FIG. 4. As there shown, various operating configurations possible with article 1 of the present disclosure are shown in a general configuration. The controller 9 is intended to be programmable to offer a number of operational modes as later described in greater detail. Those skilled in the art will recognize that the controller 9 can assume a variety of design configurations and provide any number of operational modes for the vest 22.

FIGS. 9 *a* through 9 *d* show one illustrative embodiment of the power pods 19 employed with the article 1. Each of the power pods 19 includes a housing 50 preferably constructed in two parts. The housing 50 has a connection end 51 operatively connecting the power pods 19 to the circuit 20. Each power pod 19 includes an electrical motor 53 having a connection 54 and an output shaft 52. The shaft 52 is mounted for rotation within the housing 50 along bearing structures 58 and 59. An eccentric 60 is mounted to the shaft 52 and rotates when the motor 53 is operated under the control of the controller 9. Rotation of the eccentric 60 generates a directional stroking force through the housing 50 to the body of the intended user. As indicated herein, this is an important feature of the article 1 in general and the vest 22 in particular in that the power pods 19 themselves provide a therapeutic action for the vest 22 without outside assistance in the way or need for additional adapters, connectors or applicator devices generally require by the prior art. The eccentric 60 is specifically designed for mounting on the shaft 52 along an internal opening 62 through the use of conventional fasteners used to attach the eccentric 60 to the shaft 52 through an opening 64 in the body of the eccentric 60.

While the power pods 19 find specific application in conjunction with the vest 22, because of the unique design of the power pods, other physiotherapy applications are easily adaptable to their use. Merely by way of example, FIGS. 5 *a* through 5 *d* illustrate a therapeutic wrap 72 which may be placed on various extremities of a user for various therapy applications. As shown in FIG. 5 *b*, the wrap 72 has an application side 74 having a plurality of pockets 29 having a construction similar to the pockets 29 of the vest 22. Preferably hook and loop fasteners permit wrap 72 attachment to areas requiring application therapy. Again, other connection or fastening methods are contemplated by this disclosure.

Operation of the article of this disclosure is relatively simple to understand. In the preferred embodiment, the multi-pocketed vest 22 incorporates eight power pods 19, four at the lower lobe of each lung, one on each side of a patient's body; and, four at the upper lobe of each lung, one on each side of a patient's body, with each of the eight power pods 19 positioned so that the Directional Stroking® action of each of the power pods 19 is directed toward the patient's thorax. All eight of the power pods 19 are powered by an external 120 volt or 220 volt power source, reduced down to 12 or 24 volts, or can be individually powered by a single 12 volt or 9 volt battery pack which is maybe, for example carried in a pocket in the vest 22, for complete portability (or, alternatively, each power pod 19 can be independently powered by a 9 volt or 24 volt battery attached to or within the body of vest 22). The patient or therapist then activates the hand-held, electronic control module or controller 9 which sequentially-activates the four lower-lobe power pods 19, all synchronized to provide Directional Stroking® percussion to the patient's lower lung lobes, at identical, slow frequencies of 20 cycles per second (CPS). After a preselected time (depending on the physical size of the patient), the controller 9 then automatically activates the remaining four upper-lobe power pods 19, to provide Directional Stroking® percussion to the patient's two upper lobes, with all upper-lobe power pods 19 synchronized at a slightly-higher frequency of 30 CPS, to assist in mobilizing mucus toward the patient's thorax, where it can be coughed up. It should be noted that the higher vibratory frequency also stimulates the patient's cough mechanism in the patient's throat, thereby assisting in the elimination of damaging mucus and other fluids from the lungs of the patient.

Alternative uses of the selective-segmented, sequentially-synchronized operation of the vest 22 include uses for massage purposes and/or for lymphatic drainage, for example. By wrapping the vest 22 (or a special article 1) around the leg of a patient, (See FIG. 5) for deep-tissue massage, for sequentially-synchronized massage from a patient's lower leg, upward toward a patient's hip—or from a patient's lower back, upward toward a patient's shoulders.

Other programs for controller 9 operation will be apparent to those skilled in the art. In addition, while the controller 9 is shown as being hard wired to the control panel 7, it is apparent that other forms of communication not requiring a physical connection are within the scope of the appended claims. Advances in both communication forms and electronic device advances may permit the elimination of the control panel completely, or may allow the distribution of the panel 7 functions directly to the power pod 19. These variations are merely illustrative.

As various changes could be made in the above constructions without departing from the scope of the invention, it is intended that all matter contained in the above description or shown in the accompanying drawings shall be interpreted as illustrative and not in a limiting sense.

In view of the above, it will be seen that the several objects and advantages of the present invention have been achieved and other advantageous results have been obtained.

The invention claimed is:

1. An article for administrating therapy to a user, comprising:

a device adapted to be worn by the user during therapy, the device including a first part and a second part adjustably connected to one another by at least two separate adjustment structures adjustably and independently connected to the first and second parts so as to provide adjustability to the device, a plurality of pockets formed in the device and positioned adjacent to corresponding body surface areas of the user when in use for the application of therapy;

a plurality of power pods removably mounted to the device along respective ones of said plurality of pockets for applying airway clearance therapy application of selective-segment, sequentially-synchronized percussive force to the user's body adapted to be positioned to overlay the lungs of the user, the force applied by each of the plurality of power pods simultaneously applying a first force component perpendicular to the user's body surface area and a second force component parallel to the user's body surface area and directed toward the thorax of the user to enable drainage of fluids from the lungs of the user so that the fluids can be naturally expelled, each of said plurality of power pods including a two piece enclosure having a connection end for connecting the respective power pod to an electrical circuit, and an electric motor mounted in the two piece enclosure, the electric motor having an output shaft mounted for rotation with respect to the two piece enclosure along a pair of spaced bearing structures, the output shaft having an eccentric mounted between the pair of spaced bearing structures;

an electrical circuit carried by the device for connecting each of said plurality of power pods to an electrical input connection;

a control panel having at least two input sides and an output side, the output side being operably connected to the electrical input connection of the electrical circuit;

a power supply operably connected to one of said at least two input sides of said control panel; and a user controller operatively connected to the other of said at least two input sides of said control panel.

2. The article of claim 1 wherein the control panel is integrally formed with one of the first and second parts of said device.

3. The article of claim 1 wherein the user controller is hardwired to the control panel.

4. The article of claim 1 wherein the power supply is hardwired to the control panel.

5. The article of claim 1 wherein the power supply comprises at least one battery.

6. The article of claim 1 wherein one of the at least two adjustment structures between the first and second parts of said device comprises a pair of shoulder straps wherein the pair of shoulder straps are adjustable.

7. The article of claim 1 wherein one of the at least two adjustment structures further includes an adjustable closure at least partially extending circumferentially around and between the first and second parts of the device for adjustably attaching the article to the user.

8. The article of claim 1 wherein the user controller includes a plurality of programs for operating the plurality of power pods in a plurality of selectable modes of operation.

9. The article of claim 1 wherein the article is a vest adapted to be worn by the user and the plurality of power pods are arranged to loosen and enable drainage of fluids from the lungs of the user so that the fluids can be naturally expelled.

10. The article of claim 9 wherein the article is portable.

11. A portable article for administrating therapy to a user comprising:

a device for administrating airway clearance therapy, by the application of selective-segment, sequentially-synchronized percussive force, adapted to be worn by the user during therapy, the device having at least one area corresponding to an area of the user, when in use, for which therapy is desired, and including at least one pocket;

at least one power pod for applying percussive force to the user's body adapted to be positioned to overlay the lungs of the user and removably attachable to the at least one pocket of the device at a location corresponding to said at least one area to enable drainage of fluids from the lungs of the user so that the fluids can be naturally expelled, the percussive force applied by the at least one power pod simultaneously applying a first force component perpendicular to the user's body and a second force component parallel to the user's body, the at least one power pod including a two piece enclosure having a connection end for connecting the at least one power pod to an electrical circuit, and the two piece enclosure containing an electric motor mounted in the two piece enclosure, the electric motor having an output shaft mounted for rotation with respect to the two piece enclosure along a pair of spaced bearing structures, the output shaft having an eccentric mounted between the pair of spaced bearing structures; and a power supply operatively connected to said at least one power pod.

12. The portable article of claim 11 further including a control panel operatively connected between the power supply and the at least one power pod.

13. The portable article of claim 12 wherein the control panel is integrally formed with the device.

14. The portable article of claim 13 further including a controller operatively associated with the control panel.

15. The portable article of claim 14 wherein the power supply is hardwired to the control panel.

16. The portable article of claim 14 wherein the controller includes a plurality of programs for operating the at least one power pod in a plurality of selectable modes of operation.

17. The portable article of claim 16 wherein the portable article is a vest adapted to be worn by the user, further including a plurality of power pods, wherein the plurality of power pods are arranged to loosen and liquefy fluids along and mobilize the liquefied fluids for the trachea of the user.

18. The portable article of claim 11 wherein the power supply comprises at least one battery.

19. The portable article of claim 11 wherein the device includes a first part and a second part, a plurality of pockets formed in the device and positioned to overlay the lungs of the user for the application of percussive therapy when in use, and the first and second parts of said device are attached to one another by a pair of shoulder straps.

20. The portable article of claim 19 wherein the pair of shoulder straps are adjustable.

21. The portable article of claim 20 further including at least one adjustable closure between the first and second parts of the device for attaching the portable article about the torso of the user.

22. A portable article for administering therapy to a user comprising:

a device adjustably attachable both vertically and circumferentially to the user, having at least one area corresponding to a user's body for which therapy is desired when in use and adapted to be positioned to overlay the lungs of the user for administrating airway clearance therapy, by the application of selective-segment, sequentially-synchronized percussive force, and including at least one pocket;

at least one power pod removably attachable with the at least one pocket of the device for applying percussive force to a user's body surface corresponding to said at least one area, the force applied by at least one power pod simultaneously applying a first force component perpendicular to the user's body surface and a second force component parallel to the user's body, the percussive force being sufficient to enable drainage of fluids from the lungs, the at least one power pod including a two piece enclosure having a connection end for connecting the at least one power pod to an electrical circuit, an electric motor and an eccentric mounted in the two piece enclosure, the electric motor having an output shaft mounted for rotation with respect to the two piece enclosure along a pair of spaced bearing structures, the output shaft having the eccentric mounted between the pair of spaced bearing structures, the at least one power pod providing the application of selective-segment, sequentially-synchronized percussive force; and a power supply operatively connected to said at least one power pod.

23. The portable article of claim 22 wherein the at least one power pod is positioned with respect to the device such that the force applied by the at least one power pod is applied through the housing to the user's body surface.

* * * * *